US005467153A

United States Patent [19]

Fargeot

[11] Patent Number: 5,467,153

[45] Date of Patent: Nov. 14, 1995

[54] APPARATUS FOR AUTOMATICALLY DIGITIZING PHOTOGRAPHIC SLIDES

[75] Inventor: Michel Fargeot, Denice, France

[73] Assignee: Data Fit International, Anse, France

[21] Appl. No.: 107,830

[22] PCT Filed: Feb. 27, 1992

[86] PCT No.: PCT/FR92/00180

§ 371 Date: Aug. 30, 1993

§ 102(e) Date: Aug. 30, 1993

[87] PCT Pub. No.: WO92/15922

PCT Pub. Date: Sep. 17, 1992

[30] Foreign Application Priority Data

Mar. 1, 1991 [FR] France ..... 91 02500

[51] Int. Cl.[6] ..... G03B 21/00

[52] U.S. Cl. ..... 353/103; 353/120; 353/122; 348/110

[58] Field of Search ..... 353/103, 107, 353/108, 110, 122, 120, 121; 348/96, 110, 111; 206/556, 455, 456, 562, 563; 53/520, 284.2

[56] References Cited

U.S. PATENT DOCUMENTS

| | | | |
|---|---|---|---|
| 2,503,239 | 4/1950 | Autos | 353/DIG. 1 |
| 4,415,282 | 11/1983 | Euteneuer . | |
| 4,765,734 | 8/1988 | True et al. | 353/120 |
| 4,819,073 | 4/1989 | Bridges | 348/110 |
| 4,858,003 | 8/1989 | Wirt | 353/120 |
| 5,191,406 | 3/1993 | Braudestini et al. | 355/20 |

FOREIGN PATENT DOCUMENTS

| | | |
|---|---|---|
| 252675 | 1/1988 | European Pat. Off. . |
| 329054 | 8/1989 | European Pat. Off. . |
| 2178156 | 3/1973 | France . |

*Primary Examiner*—William A. Cuchlinski, Jr.
*Assistant Examiner*—William C. Dowling
*Attorney, Agent, or Firm*—Hoffman, Wasson & Gitler

[57] ABSTRACT

Apparatus for automatically digitizing slides, the apparatus including a slide feed assembly (2), at least one digitizing and input station (D), and a reception assembly (2') for receiving slides that have been digitized in this way. Each slide feed and reception assembly (2, 2') includes at least one drawer (6) containing a removable magazine (11) which may be rotationally driven about a vertical axis and including at least one removable slide storage element (12). Transfer systems (14, 21) serve firstly to feed slides from a storage element (12) of the removable magazine (11) to a central turntable (15) which places the slides successively before various workstations including the digitizing and input station (D), and secondly transfer slides after digitizing from the central turntable (15) to a storage element (12) of a removable magazine (11) placed in said reception assembly (2'). The slide feed assembly (2) and the slide reception assembly (2') may be the same assembly.

28 Claims, 7 Drawing Sheets

FIG.1
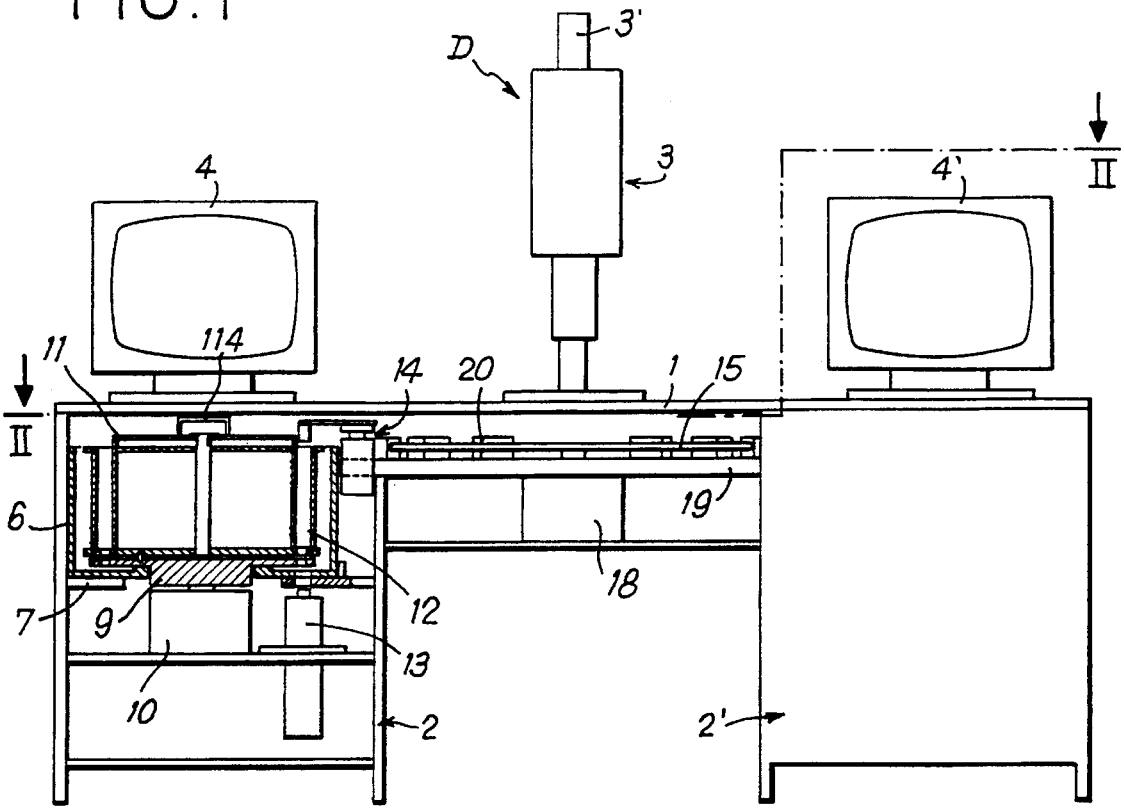
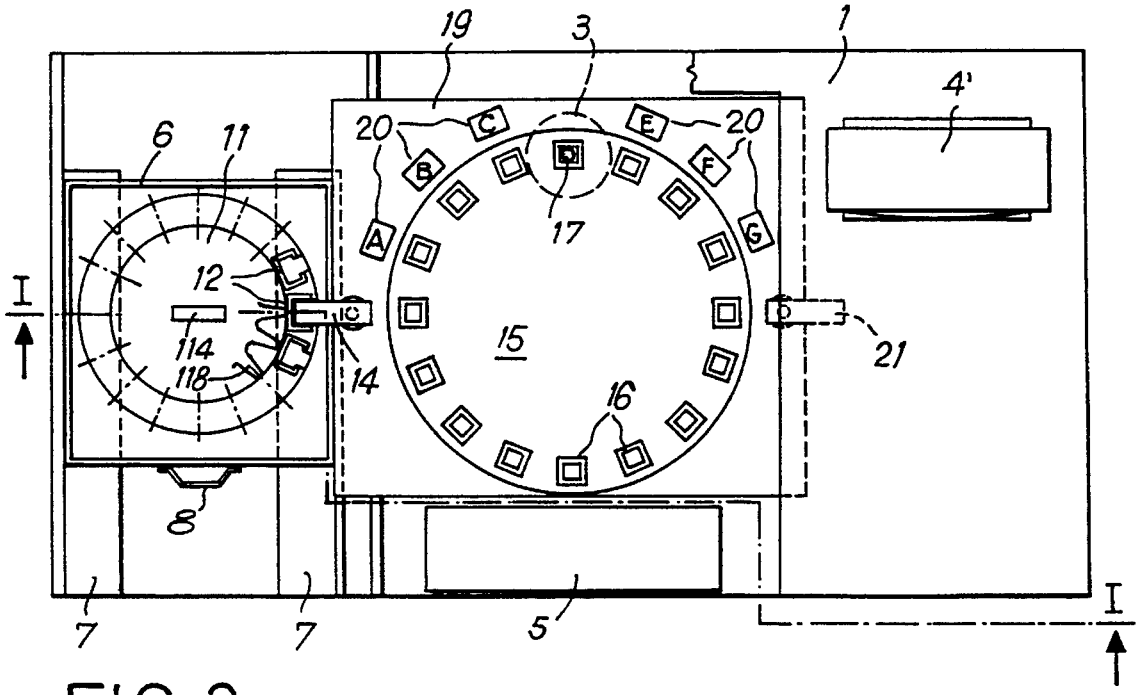
FIG.2

FIG. 3
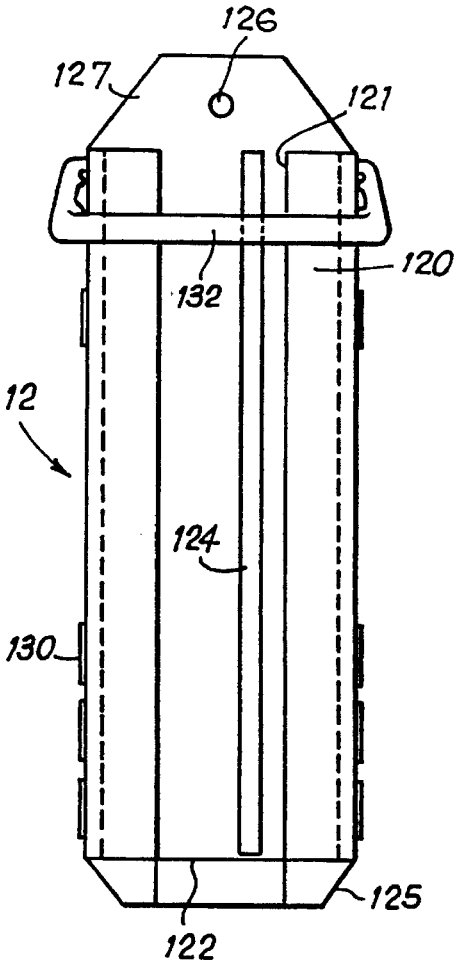
FIG. 4
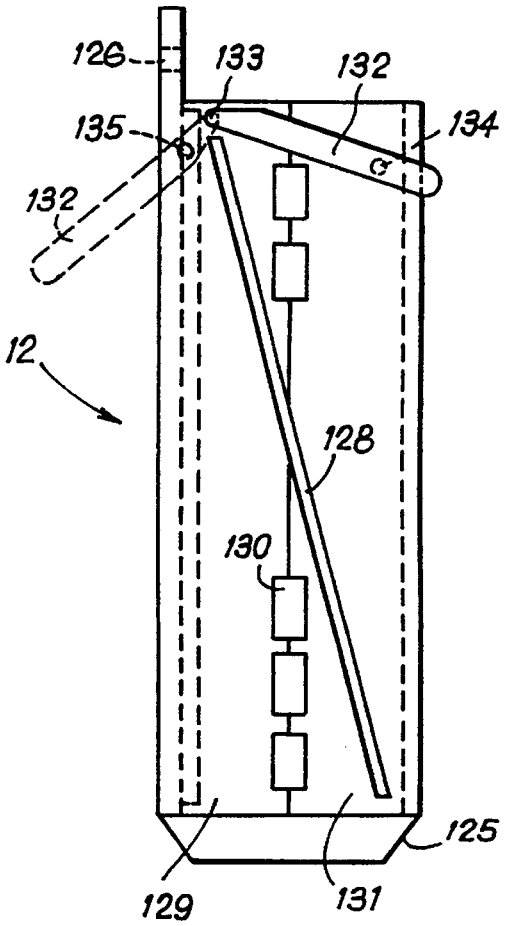
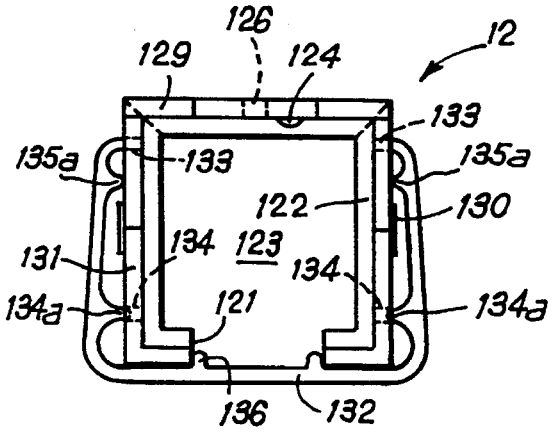
FIG. 5

FIG. 8
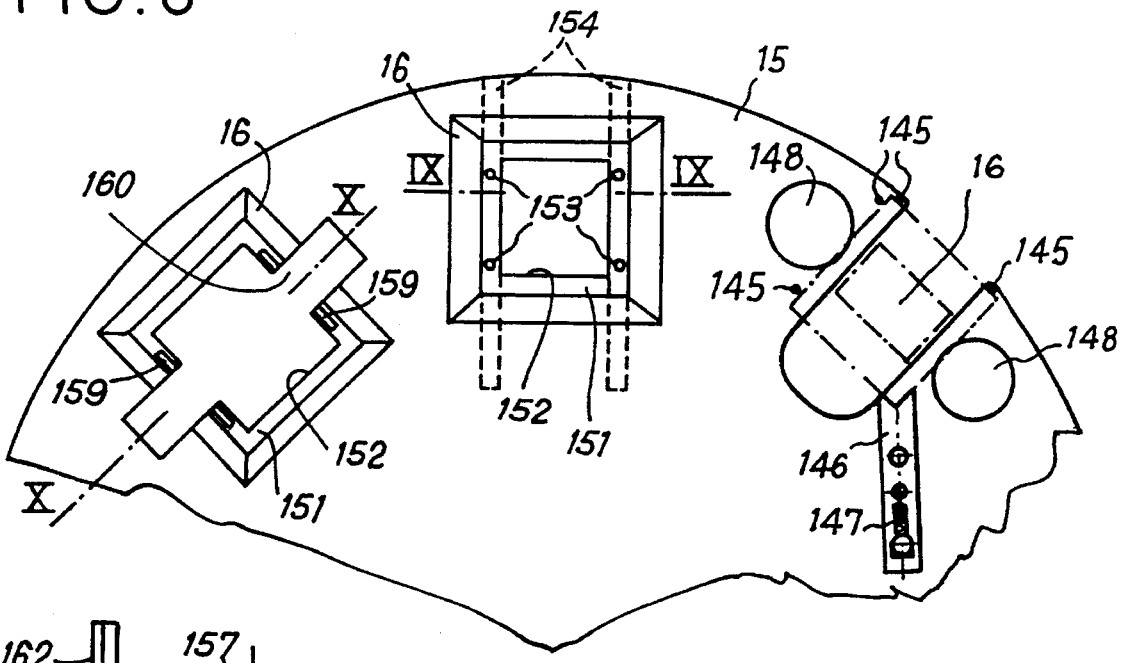
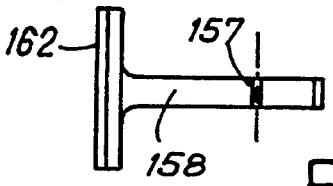
FIG. 11
FIG. 9
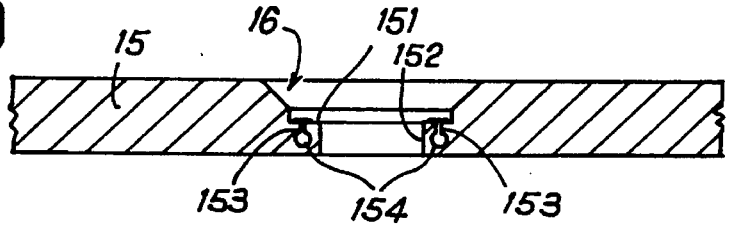
FIG. 10
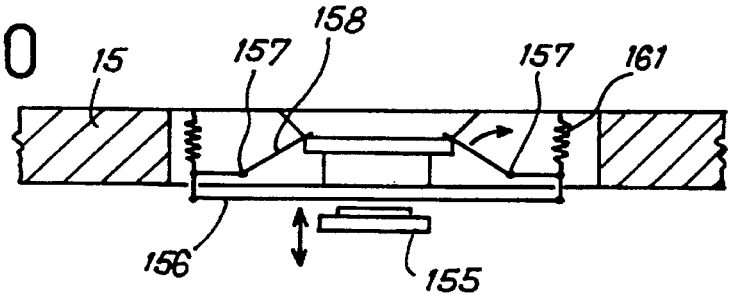

APPARATUS FOR AUTOMATICALLY DIGITIZING PHOTOGRAPHIC SLIDES

The present invention relates to an apparatus for automatically digitizing photographic slides for the purpose of digitally inputting images from the slides.

It is known at present how to input images digitally from slides. However, since this is performed manually, the resulting digitizing process is extremely slow. Furthermore, when the operation relates to thousands of slides, it is necessary to have a plurality of input stations available and thus a plurality of operators if reasonable rates of throughput are to be achieved.

The present invention seeks to remedy these major drawbacks, and in particular to enable a single input station to obtain input automatically from a very large number of slides in a very short period of time.

This object is achieved by an apparatus for automatically digitizing slides, the apparatus including a slide feed assembly, at least one digitizing and input station, and a reception assembly for receiving slides that have been digitized in this way, the apparatus being characterized in that each feed and reception assembly includes at least one drawer containing a removable vertical magazine and including at least one removable slide storage element, and in that it includes at least one transfer system serving firstly to feed slides from a storage element of said removable magazine to a central turntable which places said slides successively before various workstations including said digitizing and input station, and secondly to transfer slides after digitizing from said central turntable to a storage element of a removable magazine placed in said reception assembly.

In a first embodiment of the invention, the slide feed assembly and the slide reception assembly are disposed in line on opposite sides of the central turntable, the first and second transfer systems being disposed diametrically opposite each other on opposite sides of the central turntable.

In another possible embodiment, the slide feed assembly and the slide reception assembly are the same.

In another embodiment, a single transfer system serves firstly to feed the central turntable with slides from a first storage element of the removable magazine of the single feed and reception assembly, and secondly to transfer the slides, after digitizing, from the central turntable to a second storage element of said removable magazine.

Advantageously, the central turntable is a rotary turntable under digital control and includes, in addition to the digitizing and input station, at least one of the following additional stations: a station for displaying the frame of a slide; a station for repositioning a slide by means of a manipulator; a station for pressing down a slide by means of a manipulator; a station for reading characters on the frame of a slide by optical character recognition; a station for reading bar codes that appear on the frame of a slide; a station for deleting inscriptions that appear on the frame of a slide; alphanumeric marking station for writing alphanumeric characters on the frame of a slide; a bar code marking station for writing bar codes on the frame of a slide; a reject station for rejecting unsatisfactory slides; and a de-dusting station.

Other advantageous characteristics stem from the particular embodiments of the invention given below.

Said storage element is in the form of an open topped vertical bar of square section adapted to the slides to be digitized and of a height that is adapted to the desired storage volume, one of the longitudinal faces of the bar including an opening of restricted width up its entire height, and said storage element includes a bottom in which an opening is formed of section smaller than that of the slides to enable the slides to be stacked and unstacked with the help of a pusher penetrating into said opening.

The storage element includes a bottom end and a top end co-operating with positioning means formed in said removable magazine.

Similarly, said storage element comprises a channel section bar connected by hinges to two angle section bars, a clamp tilting about fixing holes formed in the channel section bar in order to engage in locking holes formed in the angle bars and thus close said storage element that said hinges enable to open when the clamp is raised.

Said storage element further includes a longitudinal rectilinear tongue formed on one of its inside faces and designed to co-operate with a notch formed in an edge of each slide. It is perforated with various patterns and includes, in particular, a diagonal slot formed in one of its longitudinal faces to enable the classification of slides to be visually inspected.

According to a particular characteristic, said removable magazine includes a central shaft interconnecting an intermediate plate and a bottom plate which are fixed relative to said central shaft and which include aligned openings for receiving storage elements.

The shape of an opening formed in the bottom plate is complementary to the shape of the tapered bottom end of a storage element in order to position the storage element vertically.

The removable magazine further includes a top plate provided with a handle and capable of rotating relative to said central shaft, and said top plate has peripheral tips that come flush over each storage element.

The top plate of the removable magazine carries a spring-and-ball assembly co-operating with said hole formed at the top end of a storage element in order to lock it in place.

According to another particular characteristic, the removable magazine comprises a vertical central shaft interconnecting an intermediate plate and a bottom plate which are fixed relative to said vertical shaft, each of the plates being provided in its periphery with guide pieces that are fixed radially and between which the storage elements can slide.

Said central turntable is constituted by a disk having housings pierced in is periphery for the purpose of receiving slides, said slides lying in said housings over respective openings that make it possible to digitize and input said slides by allowing light from a light source to pass therethrough.

Advantageously, the slide is held in place over the housing by a pusher which, under the effect of a spring, urges said slide against positioning pegs disposed on faces opposite from the faces on which said pusher acts directly.

In one configuration of the invention, the slide feed assembly and the slide reception assembly are the same, constituting a single assembly including a single removable magazine, which may be constituted by two fixed storage elements held by guide elements so as to define an angular sector.

Other characteristics and advantages of the present invention appear more clearly from the following description given with reference to the accompanying drawings, in which:

FIG. 1 is an overall view of apparatus in accordance with the invention for digitizing and inputting photographic slides, the view being mainly in elevation, and partially in section on line II of FIG. 2;

FIG. 2 is an overall plan view of the FIG. 1 apparatus, on line II—II of FIG. 1;

FIGS. 3 to 5 are a front view, a plan view, and a side view of a storage element adapted to the apparatus of FIGS. 1 and 2;

FIG. 8 is a fragmentary view of the central turntable of a station of the invention with housings fitted with slide-holding systems based on suction, on an electromagnet, and on a pusher;

FIGS. 9 and 10 are sections on line IX—IX and X—X of FIG. 8 respectively showing a suction system for holding slides, and an electromagnet system for holding slides;

FIG. 11 is a detailed view of the electromagnet holding system of FIGS. 8 and 10;

Figure 6:
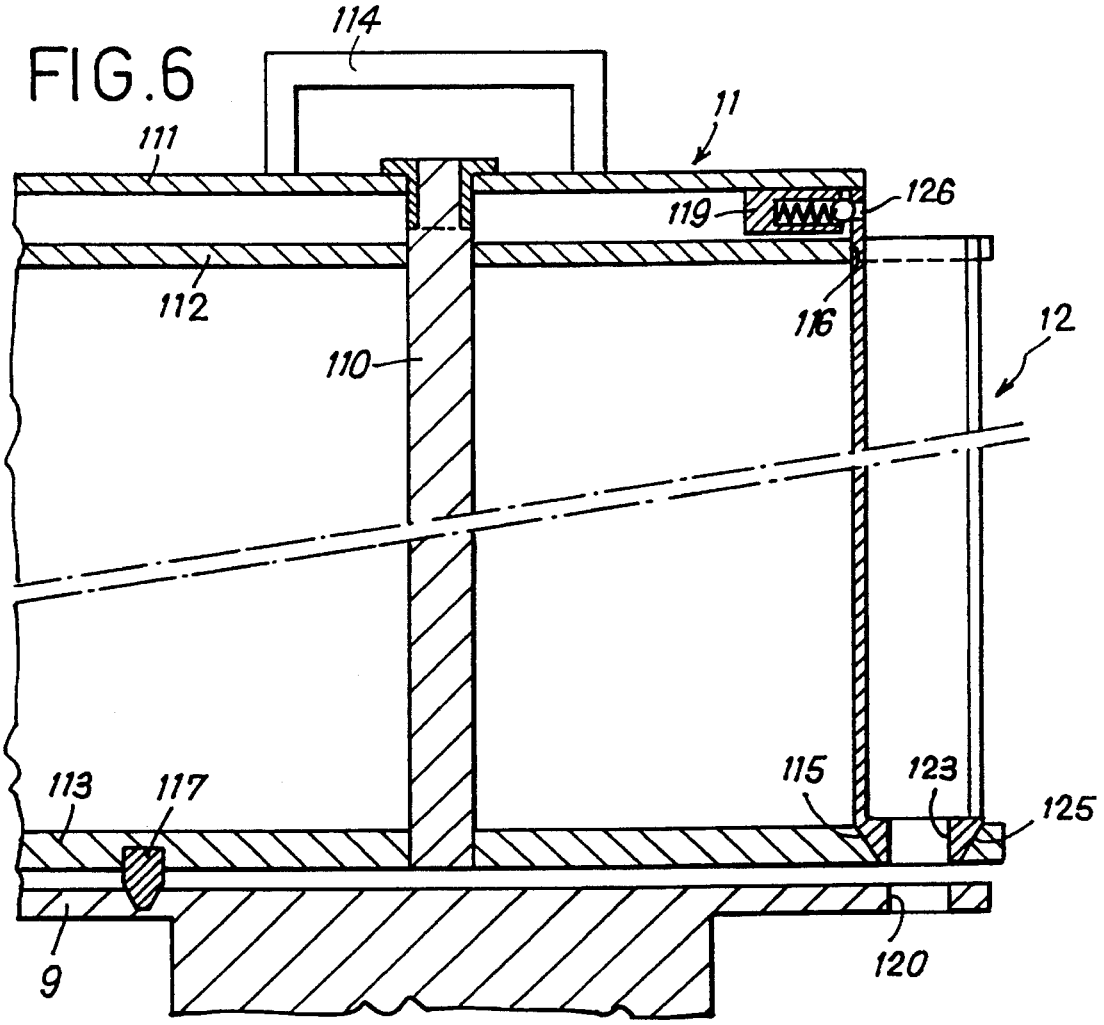
FIGS. 6 and 7 are respectively an axial section and a fragmentary plan view of a removable magazine receiving storage elements as shown in FIGS. 3 to 5.

Reference is now made to the drawings, and more particularly to FIGS. 1 and 2 which comprise a general diagrammatic view of apparatus of the invention for automatically digitizing images. More precisely, FIGS. 1 and 2 are respectively a front view and a plan view of such apparatus.

The apparatus of the invention is in the form of a piece of office furniture comprising a tabletop 1, a feed assembly 2, and a reception assembly 2' which are powered from single-phase 220 V mains by means not shown. The tabletop 1 is about 1 meter (m) by 2 m and is designed to receive the single input station comprising input means 3 that may be a camera or a scanner, for example, and a vertical support 3' therefor, two graphics screens 4 and 4, and a keyboard 5. Each of the two assemblies 2 and 2' supporting said tabletop 1 includes a plurality of drawers 6 capable of being moved on slideways 7 by an operator acting on respective handles 8. In one embodiment, each drawer 6 includes a rotary turntable 9 rotated by an electric motor 10 and supporting a removable magazine 11. The removable magazine may contain up to sixteen storage elements 12 each containing several hundred slides. An actuator 13 in association with a manipulator 14 enables the slides to be extracted from the storage element 12 and placed on a central turntable 15. The periphery of the central turntable 15 is pierced with housings 16 for receiving the slides and for allowing light to pass from a light source 17 to the camera 3. An electric motor 18 rotates the central turntable 15 which stands on a support 19. Workstations A, B, C, and D for example, enable different functions to be performed, with the main function being digital input 3, 3' and 17 under the control of computer means.

The apparatus of the invention is organized around these various functions which correspond to specific technical means.

Firstly the slides that are to be digitized must be stored. Storage elements 12 are used for this purpose and the structure and operation thereof are described in detail with reference to FIGS. 3 to 5.

A storage element 12 is in the form of a square section bar of aluminum, plastic, or other material and its height varies depending on the desired storage volume. For example, a height of 300 mm makes it possible to store about 200 slides. The front face of said storage element 12 has an opening 121 running up its entire height, thereby making it easier to stack slides. The slides are placed one on top of another starting from the bottom 122 of said element 12. The element 12 also includes an opening 123 suitable for allowing a pusher 190 to pass through for the purpose of unstacking the slides. A tongue 124 in the form of a half-disk is glued or fixed to the entire height of said element 12 and is suitable for being received in notches provided for this purpose in the frames of the slides, thus acting as keying means. The bottom 122 may be flat but on the outside it may also be tapering at 125 so as to facilitate installation in a removable magazine 11 that is specially adapted for the purpose or in an external storage bin. A hole 126 enabling such positioning to be checked and also enabling robotized storage may also be provided in the back or in a raised portion 127 of the storage element 12.

Advantageously, the storage element 12 may be perforated with various different patterns in order to allow air to flow or to reduce its weight, or else it may include a diagonal slot 128 in one of its faces to make quick visual inspection of previously-marked slides possible. Similarly, to facilitate stacking a larger number of slides, it may be preferable for said storage element 12 not to be made as a single bar but rather to be built up from a channel section bar 129 that is connected by means of hinges 130 to two angle bars 131. Thus, by rotating the bars 131 about the hinges 130 it is possible to open the storage element 12 and thereby enable it to be loaded with slides from the front, rather than solely from above. After loading has been performed it is possible, by tilting a clamp 132 down about fixing holes 133 to keep the storage element 12 closed by means of first projections **134*a* engaging in first locking holes 134. On unloading, the procedure is reversed: after pressing on the bars 131 of the clamp 132 in an upwards direction, the clamp is tilted about the holes 133, thereby enabling second projections 135*a* to be received in second locking holes 135 of said storage element 12 (position shown in dotted lines in FIG. 4), whereupon the element can be opened and the slides can be removed all together. Removing slides and also loading slides is facilitated by tilting the storage element 12 so that it stands on its clamp 132. Studs 136 secured to the front portion of the clamp enable the opening 121** to be kept constant. The assembly obtained in this way is particularly simple to use. It enables a variable quantity of slides to be stored regardless of the kind of slide mount used, e.g. plastic, glass, or cardboard, and this can be done without any kind of separation.

Figure 7:
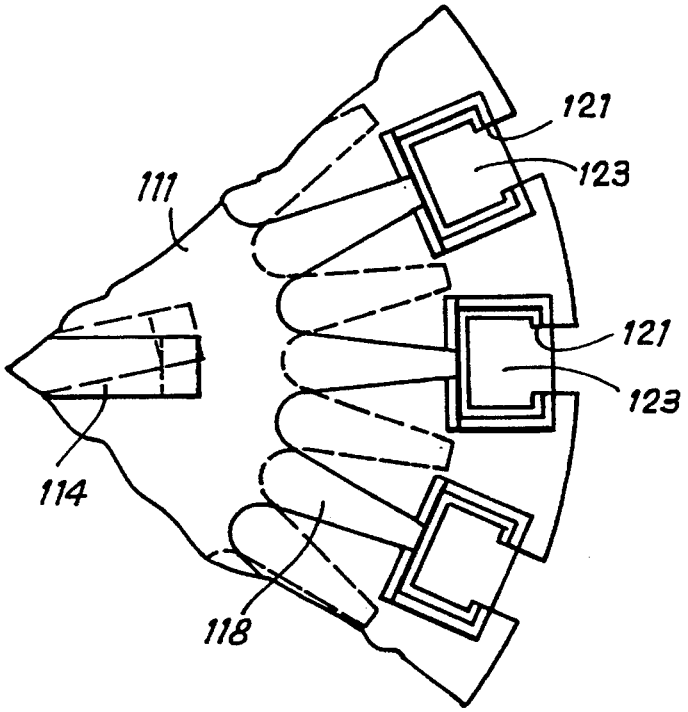

To satisfy requirements for processing several thousand slides, it is necessary, prior to such processing, to bring together a plurality of storage elements 12. To do this, use may be made of a first type of removable magazine 11 whose structure and operation are described with reference to FIGS. 6 and 7. Constituted by a variable number of storage elements 12 (e.g. 8 or 16), the magazine comprises a central shaft 110 connecting an intermediate plate 112 to a bottom plate 113, both of which plates are fixed to the central shaft 110. A top plate 111 provided with a handle 114 that facilitates transporting the magazine 11 is mounted so as to be capable of rotating freely about the central shaft 110. The intermediate and bottom plates 112 and 113 include openings 115 and 116 which correspond to the openings 120 of the turntable 9 to enable storage elements 12 to be positioned vertically, the opening 115 being complementary in shape, e.g. conical, so as to match the wall 125 of the element 12. Three conical studs 117 secured, e.g. to the turntable 9, serve to enable the turntable 9 to center the removable magazine 11 and to apply thrust thereto. The storage elements 12 are loaded into the removable magazine 11 and the magazine is loaded into the drawer 6 in several stages. While the removable magazine 11 is removed, it is fitted with the storage elements 12, the top plate 111 of said magazine 11 being in the position shown in dashed lines in FIG. 7. Once this filling operation has been completed, rotating the handle 114 causes the top plate 111 to rotate so that its tips 118 lie flush with respective storage elements 12 where they have their upwards extensions 127. Simultaneously, the ball of a ball-and-spring system 119 secured to the top plate 111 takes up position in the hole 126 provided for receiving it, thereby completing vertical positioning of each storage element 12. It is advantageous to observe that it suffices for a single storage element 12 to be improperly positioned to prevent the operator moving the top plate 111 at all. This provides particularly simple verification that the storage elements 12 are properly positioned. With the drawer 6 opened by means of the handle 8 (see FIG. 2), the loaded removable magazine 11 is placed on the turntable 9. The drawer 6 is then closed. Proper positioning of the magazine 11 or of the drawer 6 is verified by sensors such as microswitches or photoelectric cells (not shown). It should be observed at this point that it is possible to operate the apparatus with a single storage element 12. Under such circumstances, the turntable 9 is not necessary since the removable magazine 11 needs only to support the single storage element which can be put into place manually.

With the slides now in place, they are ready for automatic processing in which the first step consists in unstacking the slides one by one so as to bring them to the various workstations.

Reference is made again to FIG. 1. The effect of the actuator 13 is to push the slides upwards. The manipulator 14 then peels off a first slide by means of a vacuum-producing assembly having an electrical vane pump or the equivalent (not shown), this assembly constituting a first transfer system. After taking a slide, the manipulator 14 performs movement in rotation or translation (depending on the type of manipulator used) and the slide is placed on the central turntable 15 whose structure and operation are described with reference to FIGS. 8 to 11.

The central turntable 15 is constituted by a disk of suitable diameter, advantageously about 700 mm, being pierced in its periphery by some number of housings 16 for receiving in the horizontal position the slides from the first transfer system. The slide rests on the bottom 151 of said housing, an opening 152 enabling light to pass for the digital input system 3, 3', 17 in which the camera or scanner 3 constitutes the essential element. To ensure that the slide is properly positioned and to avoid any possible warping, the slide is pressed against the bottom 151 by a device of one of three different kinds, all three being shown together in FIG. 8 for simplification purposes.

One of the systems shown in FIG. 8 is a pusher system. In this disposition the housing 16 is a notch extending radially from the periphery of the central turntable 15. The width of the slide is greater than that of the notch so the slide stands on the housing and it is held in place by four positioning pegs 145 disposed around the slide and by a pusher 146 whose drive from a spring 147 tends to urge the slide against the pegs. While the slide is being installed, the pusher 146 is withdrawn so that the spring 147 is then compressed, e.g. by means of an electromagnet (not shown) under the control of the computer means. Once the slide has been put into position, the electromagnet is de-excited and the spring is released, thereby bringing the pusher into contact with the slide and thus ensuring that the slide is held firmly.

Advantageously, the pusher 146 is placed at a corner of the slide, with two of the pegs 145 then being disposed in the opposite corner, the other two pegs being placed on the two sides that are not in contact with the pusher. In addition, in order to make it easier to remove the slide manually, two perforations 148 may be provided on either side of the notch 16 so as to receive two fingers of an operator.

FIG. 9 shows a suction system in greater detail. The suction is created by a vacuum pump (not shown) which is connected to four suction cups 153 via a valve and two channels 154. When the slide is about to be released by the manipulator 14 and placed in the housing 16, the valve is opened, thereby releasing suction which sucks the slide and holds it against the bottom 151. The valve is then closed and the slide remains held in place until the valve is opened again while transferring the slide to the reception magazine.

FIG. 10 shows an electromagnet system. This system is more complex and it also requires mechanical parts to move. An electromagnet 155 associated with rodding 156 enables two thrust blades 158 to pivot simultaneously about stationary axes 157 for the purpose of holding the slide. At rest, these thrust blades 158 are received in two retraction grooves 159 formed in the bottom 151 of the housing 16. When the slide is about to be released by the manipulator 14, the electromagnet 155 is excited. The thrust blades 158 stand up and occupy passages 160 provided for this purpose in the housing 16, after which the slide is placed on the bottom 151. When the electromagnet 155 is de-excited, return springs 161 cause the two thrust blades 158 to move down again so that their faces 162 press the slide against the bottom 151. During transfer to the reception magazine, exciting the electromagnet 155 again causes the thrust blades 158 to stand up again thus allowing the slide to be taken away.

More simply, a slide may be held down by pressing a mask thereagainst which is held in position by a manipulator or it may be held down directly by a fork-shaped arm of the manipulator. Such a manipulator-fork assembly may constitute a specific workstation of the apparatus that may be referred to as a "conforming" or a "pressing" station.

It may be observed that none of the three above systems prevents the slide being positioned manually, with the slide subsequently being removed, for example, by means of a suction foam connected to the vacuum system of the first transfer assembly by means of a handle provided with a trigger for controlling suction or merely by hand when the housing 16 is in the form of a notch in the turntable 15 enabling the fingers of the operator to pass therethrough.

Reference is made again to FIGS. 1 and 2. Rotation of the central turntable 15 enables each slide to be presented in succession to the various workstations A to D. These are fixed on standard base plates 20 that are disposed around the central turntable 15 on a support 19, thereby making them very easily interchangable and also enabling the apparatus to be adapted to new functions.

The bottom of the base plate is fitted with two centering pegs and with a fixing screw enabling it to be positioned and fixed on any one of the workstations and thus eliminating any problems of adjustment.

This aspect is dealt with in the factory when each base plate is mounted on the corresponding fixing support of the various means.

The first function performed by the apparatus of the invention is orienting the slide. That is to say repositioning a wrongly positioned slide so that it is the right way up and the right way round so as to enable it to be input properly. For this purpose, corresponding workstation A has an assembly (not shown) including a cell that senses or does not sense a light source illuminating a corner of the slide, and a manipulator enabling the slide to be rotated or turned over so as to position it. In a minimal configuration of the apparatus of the invention, the slide is then brought to workstation D which corresponds to digital input of the image. It includes elements that have already been described, a light source 17, a camera or scanner 3, and a support 3' which are associated with computer means (not shown for the most part, except for the graphics screens 4 and 4') that serve to control the entire apparatus. This mainly comprises graphics processing of the image, managing image files and displaying them, and supervising the automatic equipment concerning rotation of the turntables and the rates at which digitizing and manipulation are performed (in particular the central turntable 15 must pause for about 5 seconds while inputting is taking place). Once inputting has been completed, the slide is brought to a second transfer system analogous to the first and including, in particular, a manipulator 21. Thus, the slides are stacked again one after another, retaining the unstacking order, but in a new storage element 12 of a new removable magazine 11 contained in a drawer 6 of a reception assembly 2' that is an image of the feed assembly 2.

In a more advanced configuration, as shown in FIG. 2, the apparatus of the invention may include up to nine workstations, including the two transfer systems. However, if the manipulators 14 and 21 are moved further apart, e.g. so that they are separated by an angle of about 270° about the central turntable 15, then there would be room for even more workstations, or the same result could be achieved by increasing the diameter of the central turntable 15. It would also be possible to use only one manipulator in association with a feed assembly 2 and a reception assembly 2' by considerably modifying the respective dispositions of the removable magazines 11 and of the central turntable 15, or else it would be possible to use a single removable magazine 11 belonging to a single device both for feeding and for receiving the slides. In which case it would be possible to envisage a removable magazine that does not rotate but that merely possesses two storage elements, one for feeding slides and the other for receiving slides. These two elements preferably bear against a cylindrical surface so as to occupy a circular sector.

Figure 12:
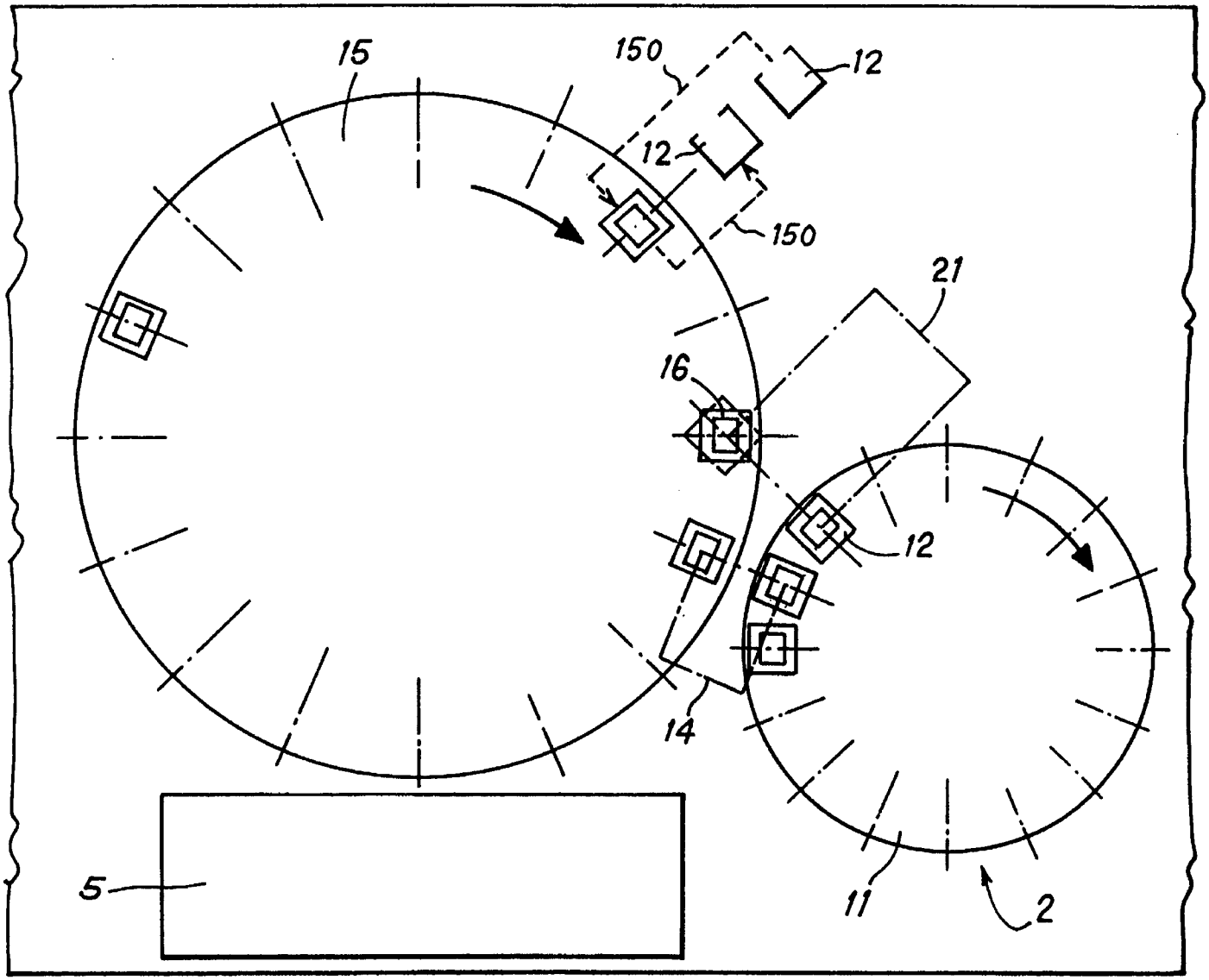
FIG. 12 is a plan view of the digitizing and input apparatus in another embodiment of the invention.

FIG. 12 shows a configuration including a single removable rotary magazine 11, a central turntable 15, and two manipulators 14 and 21.

The manipulator 14 which unstacks the slides may be driven with a single translation motion and with two up-and-down motions. The manipulator 21 which performs restacking must also be capable of an orienting motion to reposition slides properly in the storage element 12 after they have been extracted from the housings 16 (the position of a slide after translation and before rotation is shown in dashed lines on the central turntable 15). It should be observed that these operations of restacking and of unstacking could also be performed by a single manipulator, but at the cost of reduced throughput.

One or more workstations may be allocated a specific marking function. It may be advantageous to mark the supporting frame (mount) of each slide with a classification reference mark that may be expressed readably or in the form of a bar code associated with a commentary in the clear concerning the subject or photographer. To do this, a first workstation may be constituted, for example, by a labelling machine capable of placing said bar codes on the mounts of the slides and operating in communication with the computer means. Another workstation may include an ink jet printer for writing the desired text in the clear. Similarly, bar code reader means or character reader means may be necessary for automatically identifying a particular slide or a particular batch of slides. A workstation including a scanner or other optical means would then be useful. When reworking an existing collection, it may be necessary to change identification in the clear or in bar code on a slide mount that has already been annotated. First the existing text is read, and then a white strip is deposited or printed and finally the desired text is reprinted. It may happen that identification is not possible, in which case printing is not performed. Under such circumstances, it is useful to provide a reject station for unsatisfactory slides and for substituting a reject slide with another slide referred to as a "pseudo-slide" that is easily recognizable, for example by having a colored mount (unlike normal slides that generally have a white mount). Such a station consists in a linear manipulator 150 enabling the reject slide to be taken from the central turntable 15 and placed in a first storage element 12 and then enabling a pseudo-slide to be taken from a second storage element 12 and placed on the central turntable replacing the reject slide. This operation is repeated for each unsatisfactory slide. At the end of the digitizing process, the slides put away in the first storage element 12 are processed manually and then reintegrated in the storage elements in the reception magazine instead of the corresponding easily-identified pseudo-slides. To allow for optional drying, the printing and reprinting stations may be placed, for example, at B and at E as shown in FIG. 1. Finally, it is also advantageous to provide a de-dusting station.

Figure 13:
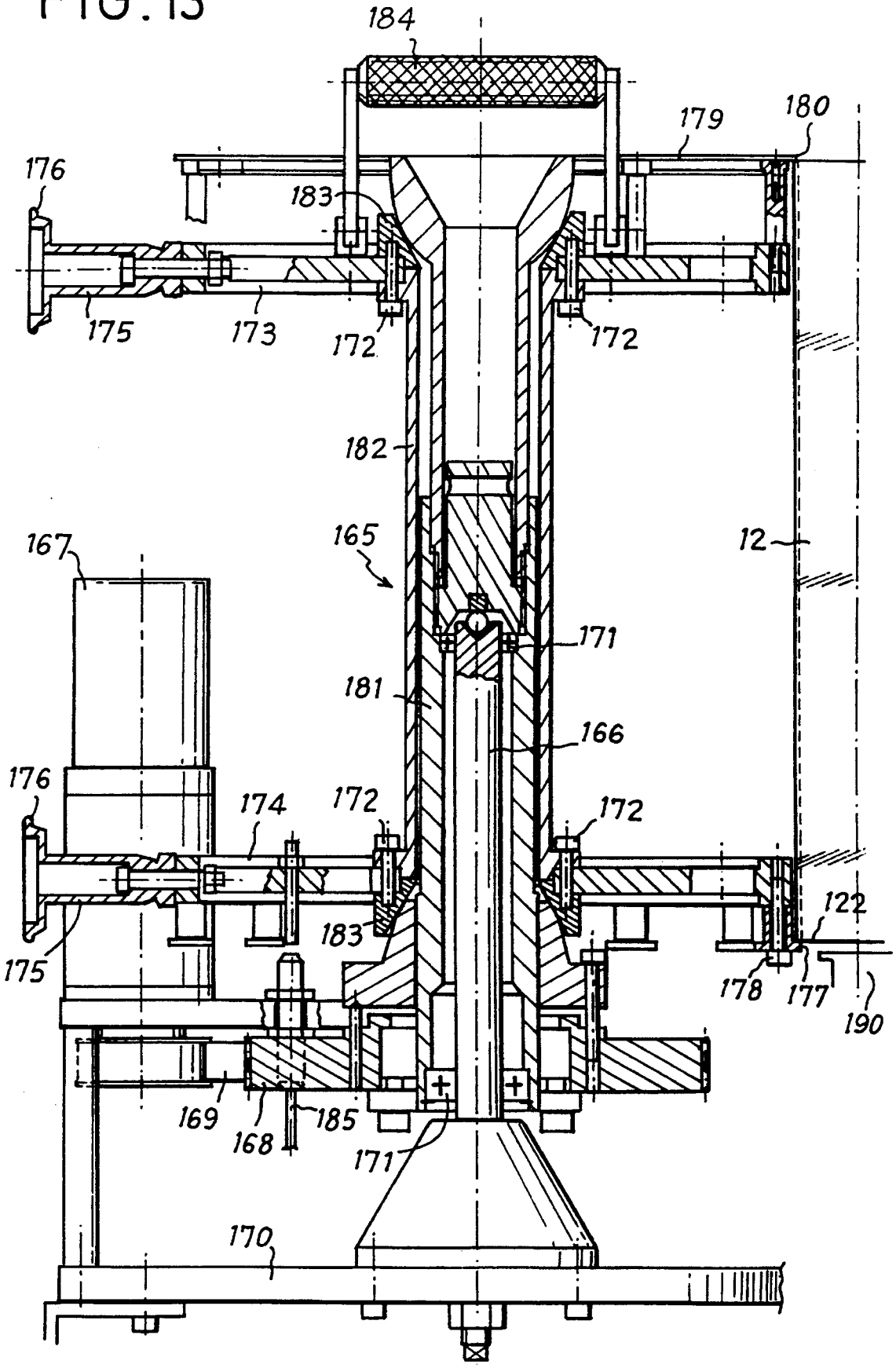
FIG. 13 is a section through another embodiment of the removable magazine.
Figure 14:
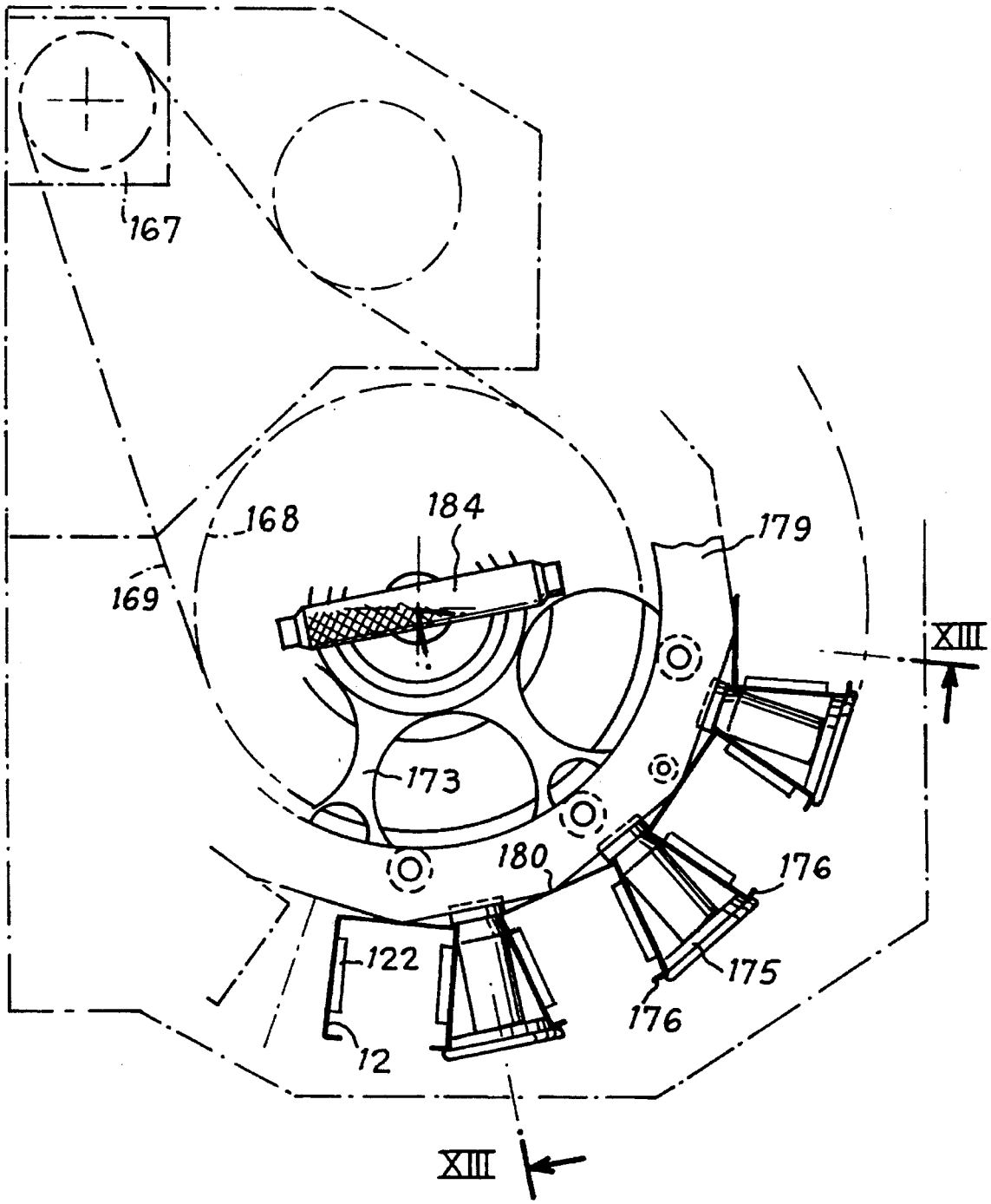
FIG. 14 is a fragmentary plan view of the FIG. 12 magazine.

FIGS. 13 and 14 show another embodiment of the removable magazine 11. The magazine 11 includes a hollow cylindrical body 165 rotated about a central vertical shaft 166 by a drive motor 167 disposed parallel to the central shaft, with the coupling between the motor and the cylindrical body being provided by a sprocket wheel 168 and a cog belt 169. The drive motor and the vertical central shaft are fixed to a support 170 secured to the drawer 6, and ball bearings 171 mounted on the central shaft allow the cylindrical body 165 to rotate relative to the central shaft 166.

Fixing elements 172 serve to fix plates 173 and 174 to the cylindrical body 175, said plates having regularly spaced apart T-shaped pieces 175 fixed to their peripheries for guiding the storage elements 12. There are twenty-four of these guide pieces 175 for a removable magazine that contains 12 storage elements, and they are disposed radially at the periphery of an intermediate plate 173 and of a bottom plate 174 of said magazine 11 in order to co-operate respectively with the top portion and with the bottom portion of respective storage elements 12.

The storage elements 12 are held in the vertical position by the guide elements 175 between which they are capable of sliding. Retaining means 176 formed at the ends of the guide pieces prevent the storage elements being ejected by centrifugal force. Abutments 177 secured to the bottom plate 174 by fixing elements 178 prevent said elements 12 moving vertically under the effect of gravity by coming into contact with the bottom 112 of the storage elements 12. After the storage elements 12 have been installed in the removable magazine 11, these elements are locked in place by rotating a top plate 179 that is in the form of a 12-sided polygon if the magazine 11 has twelve elements 12, with the tips 180 of its edges coming flush with each of the storage elements 12. A vertically movable pusher 190 can penetrate into the storage elements 12 through their open bottoms 122, thereby enabling slides to be stacked and unstacked.

The cylindrical body 165 is mainly constituted by two portions that engage one in the other, an inside portion 181 to which the sprocket wheel 168 is fixed and that remains in contact with the central shaft 166 when the magazine 11 is extracted from the drawer 6, and an outside portion 182 which supports the bottom, intermediate, and top plates 174, 173, and 179, and which can be lifted off by means of a handle 184. Cushioning pads 183 fixed to the outside portion 182 of the body 165 at its bottom plate 174 and its top plate 173 limit shocks when the removable magazine 11 is being put into place. Proper positioning of the magazine is verified by various sensors or photoelectric cells, e.g. an electromagnetic sensor 185.

It should also be observed that the computer means enable the apparatus to be highly flexible, and in particular they enable slides to be processed in batches, which may be classified or reclassified as a function of various criteria. Thus, while the slides are brought to the central turntable 15 by means of the manipulator 14, the other manipulator 21 unloads slides that correspond to a selected and recognized criterion. The cycle is repeated for other criteria. Once processing has completed, all of the slides are to be found in the reception assembly 2' and the computer means have full knowledge of the contents of the storage elements 12 contained in the removable magazine 11 of said assembly 2'.

In addition to the various functions described above and that can be performed in a single pass of a slide due to the design of the station, the invention also makes it possible to implement all of the possibilities that batch processing offers.

Each batch may be identified by a pseudo-slide that can be detected by a photo cell. In this case the pseudo-slide is constituted by an ordinary slide frame on which notes appear concerning the entire batch of slides to follow. This pseudo-slide thus includes a video image. The beginning and the end of each batch are thus identified and can be used for triggering special operations.

In addition, if it is assumed that all processing is terminated by an empty batch, the pseudo-slide for identifying the empty batch serves to identify the end of processing.

A pseudo-slide also serves to perform operations at the beginnings of batches. That is when data common to all of the slides in the batch is generated.

For example, the following information may appear on a pseudo-slide:

| | |
|---|---|
| Identification: | report number<br>date |
| Legend: | photographer's name<br>place<br>event. |

The above data can be duplicated on each slide mount in the batch and/or can be automatically integrated in the text data base associated with the batch that is about to be processed.

The data may be stored in various different ways:

a) on the mount portion of the pseudo-slide. Under such circumstances, it is necessary to have a bar code reader or an OCR reader and to provide check keys for verifying that reading has taken place properly;

b) on a hard disk or floppy disk file that is predefined before input takes place;

c) by stopping the station which emits a signal for the attention of an operator who is then required to key in the data that is to be duplicated.

Other operations may be triggered:

counters may be reset to an initial state;

images may be transferred over a network; etc. . . . .

Various end-of-batch operations may be likewise triggered by an end-of-batch pseudo-slide:

totals may be displayed;

checks may be started concerning the number of slides digitized, the storage space available, etc. . . . ;

various functions concerning imagers and documentary searching.

For optimizing sorting, mechanically speaking, two rotary systems need to be controlled:

i) the central turntable 15 which is very light in weight; and ii) the turntable 9 of the removable magazine 11 for reception purposes.

Since the reception magazine has only one pusher, each rotation of one or more storage elements 12 requires the pusher to be lowered and then raised. It is therefore necessary to minimize rotations of the turntable 9.

To do this, slides are handled as follows:

Stage 1

The first slide positioned on the central turntable 15 is read to discover the first character or the first string. The turntable 9 is positioned accordingly.

Stage 2

The system continues to feed the central turntable 15 with slides and simultaneously slides corresponding to the first letter or the first string are unloaded. The controlling software records all the stations that have been released in order to be able to refill them. This stage comes to an end when there remain no further slides on the turntable 15 belonging to the first character or the first string.

Stage 3

To define the second string or the second character to be taken into account, the software analyzes the contents of the central turntable 15 so as to perform an optimum selection that enables the largest number of slides to be unloaded. Once this selection has been performed, processing returns to stage 2.

Stage 4

Once all of the slides have been processed, the removable reception magazine 11 has one or more storage elements 12 containing all of the slides corresponding to a character or to a string. The software can then print out or display this distribution. The user then has the option of continuing processing for:

sorting on a last character;

merging strings.

Under such circumstances, the magazines are swapped over and processing returns to stage 1, the software now having knowledge of the contents of the storage elements 12.

Naturally, the software manages volume displacements with reference to the capabilities of the storage elements 12.

What is claimed is:

1. An apparatus for automatically digitizing slides, the apparatus including a slide feed assembly (2), at least one digitizing and input station (D), and a reception assembly (2') for receiving slides that have been digitized in this way, the apparatus being characterized in that each feed and reception assembly (2, 2') includes at least one drawer (6)

containing a removable vertical magazine (11) and including at least one removable slide storage element (12), and in that it includes at least one transfer system (14, 21) serving firstly to feed slides from a storage element (12) of said removable magazine (11) to a central turntable (15) which places said slides successively before various workstations including said digitizing and input station (D), and secondly to transfer slides after digitizing from said station (D) to a storage element (12) of a removable magazine (11) placed in said reception assembly (2').

2. An apparatus for automatically digitizing slides according to claim 1, characterized in that said storage element (12) is in the form of an open topped vertical bar of square section adapted to the slides to be digitized and of a height that is adapted to the desired storage volume, one of the longitudinal faces of the bar including an opening (121) of restricted width up its entire height, and in that said storage element (12) includes a bottom (122) in which an opening (123) is formed of section smaller than that of the slides to enable the slides to be stacked and unstacked with the help of a pusher (190) penetrating into said opening.

3. An apparatus for automatically digitizing slides according to claim 2, characterized in that said storage element (12) includes a tapering bottom end (125) and a top end (127) that extends one of the longitudinal faces of the storage element (12) and is pierced by a hole (126), said bottom and top ends (125, 127) co-operating with positioning means formed in said removable magazine (11).

4. An apparatus for automatically digitizing slides according to claim 2, characterized in that said storage element (12) comprises a channel section bar (129) connected by hinges (130) to two angle section bars (131), a clamp (132) tilting about fixing holes (133) formed in the channel section bar (129) in order to engage in locking holes (134) formed in the angle bars (131) and thus close said storage element (12) that said hinges (130) enable to open when the clamp (132) is raised.

5. An apparatus for automatically slides according to claim 2, characterized in that said storage element (12) further includes a longitudinal rectilinear tongue (124) formed on one of its inside faces and designed to co-operate with a notch formed in an edge of each slide.

6. An apparatus for automatically digitizing slides according to claim 2, characterized in that said storage element (12) is perforated with various patterns and includes, in particular, a diagonal slot (128) formed in one of its longitudinal faces to enable the classification of slides to be visually inspected.

7. An apparatus for automatically digitizing slides according to claim 1, characterized in that the removable magazine (11) comprises a vertical central shaft (165) interconnecting an intermediate plate (173) and a bottom plate (174) which are fixed relative to said vertical shaft (165), each of the plates (173, 174) being provided in its periphery with guide pieces (175) that are fixed radially and between which the storage element (12) can slide.

8. An apparatus for automatically digitizing slides according to claim 1, characterized in that said removable magazine (11) includes a central shaft (110) interconnecting an intermediate plate (112) and a bottom plate (113) which are fixed relative of said central shaft (110) and which include aligned openings (116 and 115) for receiving storage element (12).

9. An apparatus for automatically digitizing slides according to claim 8, characterized in that said storage element (12) includes a tapering bottom end (125) and a top end (127) that extends one of the longitudinal faces of the storage element (12) and is pierced by a hole (126), said bottom and top ends (15, 127) co-operating with positioning means formed in said removable magazine (11); and the shape of an opening (115) formed in the bottom plate (113) is complementary to the shape of the tapered bottom end (125) of a storage element (12) in order to position the storage element vertically.

10. An apparatus for automatically digitizing slides according to claim 7, characterized in that the removable magazine (11) further includes a top plate (111, 179) provided with a handle (114, 184) and capable of rotating relative to said central shaft (110, 165), and in that said top plate (111, 179) provided with a handle (114, 184) and capable of rotating relative to said central shaft (110, 165), in that said top plate (111, 179) has peripheral tips (118, 180) that come flush over each storage element (12).

11. An apparatus for automatically digitizing slides according to claim 10, characterized in that the top plate (111) of the removable magazine (11) carries a spring-and-ball assembly (119) co-operating with a hole (126) formed at the top end (127) of a storage element (12) in order to lock it in place.

12. An apparatus for automatically digitizing slides according to claim 10, characterized in that the bottom plate (174) of the removable magazine (11) carries an abutment (177) for co-operating with the bottom (122) of the storage element (12) to prevent any downward vertical displacement thereof.

13. An apparatus for automatically digitizing slides according to claim 1, characterized in that said central turntable (15) is constituted by a disk having housings (16) pierced in its periphery for the purpose of receiving slides, said slides resting in said housings over respective openings (152) that make it possible to digitize and input said slides by allowing light from a light source to pass therethrough.

14. An apparatus for automatically digitizing slides according to claim 13, characterized in that the slide is held in place over the housing (16) by a pusher (146) which, under the effect of a spring (147), urges said slide against positioning pegs (145) disposed on faces opposite from the faces on which said pusher (146) acts directly.

15. An apparatus for automatically digitizing slides according to claim 1, characterized in that the slide feed assembly (2) and the slide reception assembly (2') are disposed in line on opposite sides of the central turntable (15), the first and second transfer systems (14, 21) being disposed diametrically opposite each other on opposite sides of the central turntable (15).

16. An apparatus for automatically digitizing slides according to claim 1, characterized in that the slide feed assembly (2) and the slide reception assembly are the same, constituting a single assembly including a single removable magazine (11).

17. An apparatus for automatically digitizing slides according to claim 16, characterized in that it comprises a single transfer system (14) serving firstly to feed the central turntable (15) with slides from a first storage element (12) of the removable magazine (11) of the single feed and reception assembly (2), and secondly to transfer slides after digitizing from the central turntable (15) to a second storage element (12) of said removable magazine (11).

18. An apparatus for digitizing slides according to claim 16, characterized in that the single removable magazine (11) is stationary and is constituted by two storage elements (12) that slide between three pairs of guide elements (175), said guide elements and said storage elements thus bearing against a cylindrical surface.

19. An apparatus for automatically digitizing slides according to claim 1, characterized in that the central turntable 915) is a rotary turntable under digital control and includes, in addition to the digitizing and input station (D), at least one of the following additional stations: a station for displaying the frame of a slide; a station for repositioning a slide by means of a manipulator; a station for reading characters on the frame of a slide by optical character recognition; a station for reading bar codes that appear on the frame of a slide; a station for deleting inscriptions that appear on the frame of a slide; alphanumeric marking station for writing alphanumeric characters on the frame of a slide; a bar code marking station for writing bar codes on the frame of a slide; a reject station for rejecting unsatisfactory slides; and a de-dusting station.

20. A removable element for storing slides, characterized in that it is in the form of an open topped vertical bar of square section adapted to the format of slide frames and of a height adapted to a desired storage volume, in that one of the longitudinal faces of the bar includes an opening (121) of limited width up its entire length, and in that the storage element (12) includes a bottom (122) in which an opening (123) is formed of section smaller than that of the slides, thereby enabling the slides to be stacked and unstacked by means of a pusher (190) penetrating through said opening (123).

21. A removable storage element according to claim 20, characterized in that it includes a tapered bottom end (125) and a top end (127) that extends to one of the longitudinal faces of the storage element (12) and that is pierced by a hole (126), said bottom and top ends (125, 127) co-operating with positioning means formed in a removable vertical magazine (11) for receiving said storage element (12).

22. A removable storage element according to claim 20, characterized in that it comprises a channel section bar (129) connected via hinges (130) to two angle bars (131), a clamp (132) tilting about fixing holes (133) formed in the channel section bar (129) to engage in locking holes (134) formed in the angle bars (131), thereby closing said storage element (12) which said hinges (130) enable to be opened when the clamp (132) is raised.

23. A removable storage element according to claim 20, characterized in that it further includes a longitudinal rectilinear tongue (124) formed on one of its inside faces and designed to co-operate with a notch formed in the edge of each slide.

24. A removable storage element according to any one of claims 20 to 23, characterized in that it is perforated with different patterns and includes, in particular, a diagonal slot (128) formed in a longitudinal face to enable the classification of the slides to be inspected visually.

25. An apparatus for automatically digitizing slides, the apparatus comprising a slide feed assembly (2), at least one digitizing and input station (D), and an assembly (2') for receiving slides that have been digitized in this way, the apparatus being characterized in that each feed and reception assembly (2, 2') includes at least one drawer (6) containing a vertical removable magazine (11) and including at least one removable slide storage element (12), and in that it includes at least one transfer system (14, 21) serving firstly to feed slides from a storage element (12) of said removable magazine (11) at least to said digitizing and input station (D), and secondly to transfer slides after digitizing from said station (D) to a storage element (12) of a removable magazine (11) placed in said reception assembly (2') .

26. An apparatus for automatically digitizing slides according to claim 25, characterized in that said storage element (12) is in the form of an open topped vertical bar of square section adapted to the slides to be digitized and of height adapted to the desired storage volume, one of the longitudinal faces of the bar having an opening (121) of limited width running up its entire height, and in that said storage element (12) includes a bottom (122) in which an opening (123) is formed of section smaller than that of the slides to enable the slides to be stacked and unstacked by means of a pusher (190) penetrating through said opening.

27. An apparatus for automatically digitizing slides according to claim 25, characterized in that said storage element 912) includes a tapering bottom end (125) and a top end (127) that extends one of the longitudinal faces of the storage element (12) and that is pierced by a hole (126), said bottom and top ends (125, 127) co-operating with positioning means formed in a removable vertical magazine (11) for receiving said storage element (12), the apparatus being characterized in that said removable magazine (11) includes an intermediate plate (112) and a bottom plate (113) which are stationary and include aligned openings (116, 115) for receiving a storage element (12), and in that the opening (115) formed in the bottom plate (113) is complementary in shape to the shape of the tapering bottom end (125) of a storage element (12) so as to position the storage element vertically.

28. An apparatus according to claim 25, characterized in that it includes a removable magazine designed to contain two storage elements (12), one for feeding slides and the other for receiving said slides.

* * * * *